United States Patent [19]

Bauer et al.

[11] Patent Number: 4,482,233

[45] Date of Patent: Nov. 13, 1984

[54] ARRANGEMENT FOR INTRODUCTION OF A FILM MAGAZINE IN A FILM-PROCESSING UNIT

[75] Inventors: Walter Bauer; Heinrich Farber, both of Munich; Rudolf Schneider, Pfaffenhofen, all of Fed. Rep. of Germany

[73] Assignee: Agfa-Gevaert Aktiengesellschaft, Leverkusen, Fed. Rep. of Germany

[21] Appl. No.: 531,593

[22] Filed: Sep. 12, 1983

[30] Foreign Application Priority Data

Sep. 10, 1982 [DE] Fed. Rep. of Germany ..... 3233559

[51] Int. Cl.[3] ..... G03D 13/06

[52] U.S. Cl. ..... 354/312; 354/319; 378/182; 414/411

[58] Field of Search ..... 354/310, 311, 312, 315, 354/316, 319, 320, 322, 21; 441/411, 403; 378/182

[56] References Cited

U.S. PATENT DOCUMENTS 3,934,735 1/1976 Schmidt ..... 378/182
4,239,366 12/1980 Vackier ..... 354/310
4,244,645 1/1981 Vackier ..... 354/310
4,249,819 2/1981 Boser et al. ..... 354/312
4,365,793 12/1982 Blokland et al. ..... 414/411

*Primary Examiner*—A. A. Mathews
*Attorney, Agent, or Firm*—Michael J. Striker

[57] ABSTRACT

An arrangement for introduction of a film magazine into a film-processing device has a housing which defines an inlet slot through which the film magazine is inserted. The film magazine has a film stack carrier provided with at least one opening for removal of the film and a casing member which is movable with respect to the film stack carrier. In order to guarantee the light-tight shielding during the introduction of the film magazine, a shutter is provided along the inlet slot which is parallel movable within the interior of the housing and serves as support for the film stack carrier. The shutter has a circumferential edge which cooperates with a respective circumferential edge of the housing for providing a first light-tight shielding and a second light-tight shielding is provided through cooperation of the circumferential edge with a respective groove provided in the casing member.

19 Claims, 4 Drawing Figures

ARRANGEMENT FOR INTRODUCTION OF A FILM MAGAZINE IN A FILM-PROCESSING UNIT

BACKGROUND OF THE INVENTION

The invention relates to an arrangement for introduction of a film magazine in a film-processing unit.

The film magazine to be used with the respective film-processing unit includes a casing member and a film stack carrier containing the individual film sheets. The film stack carrier is releasably connected with the casing member and has an opening for providing access to the film stack.

When using such arrangements in combination with the film magazines, there is the basic difficulty that during the introduction of the film magazine into the opening of the film-processing unit it must be guaranteed at each time that no light can penetrate either into the film-processing unit or into the interior of the film magazine. Moreover, such an arrangement for introduction of the film magazine must be secured against errors due to operation, since the films contained in and/or received by the film magazine is exposed under exposure of the patients to irradiation, so that a repetition of the pictures would lead not only to an increase of expenses but also to further exposure of the patients to irradiation.

SUMMARY OF THE INVENTION

It is the object of the present invention to provide an arrangement for introduction of a film magazine which prevents any light from penetrating into the film-processing unit and into the interior of the film magazine.

Moreover, it is an object of the present invention to provide an arrangement for introduction of a film magazine which is easy to operate and reliable in operation.

In keeping with these objects and with others which will become apparent hereinafter, one feature of the invention resides, briefly stated, in an apparatus for introduction of a film magazine in a film-processing device which comprises a housing defining an interior and being provided with an inlet slot through which the film magazine is introduced into the interior, and means for moving the film magazine in direction of introduction from a first position in which the film magazine is placed into the inlet slot via a second position in which the connection between the film stack carrier and the casing member is released to a third position in which the film stack carrier has performed a relative movement with respect to the casing member so that the film stack is accessible through the opening, wherein the moving means cooperate with the housing to provide a light-tight shielding of the interior of the housing when the film stack magazine is in the first position, and wherein the housing cooperates with the casing member to provide a second light-tight shielding when the film magazine reaches the second position and is moved into a third position so as to prevent an undesired exposure of the film stack within the film stack carrier.

The moving means includes a shutter which extends along the inlet slot of the housing so that a further light-tight shielding of the interior of the housing is provided when no film magazine is placed into the inlet slot.

For providing the respective light-tight shieldings, the shutter has a circumferential edge of approximately W-shaped cross section, which edge cooperates with a circumferential edge of the housing so that a labyrinth-like light-tight shielding is obtained when the shutter is in the first position. A second light-tight sealing in a labyrinth-like manner is provided by the cooperation of the circumferential edge of the housing with a respective groove provided in the casing member of the film magazine.

Since the shutter is movable parallel in direction of introduction of the film magazine, the arrangement according to the invention for introduction of a film magazine in a film-processing unit guarantees at each time that the respective light-tight shieldings between the shutter and the housing, on the one hand, and between the housing and the casing member of the film magazine prevent any undesired exposure of the film sheets within the film stack carrier and within the interior of the film-processing unit.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
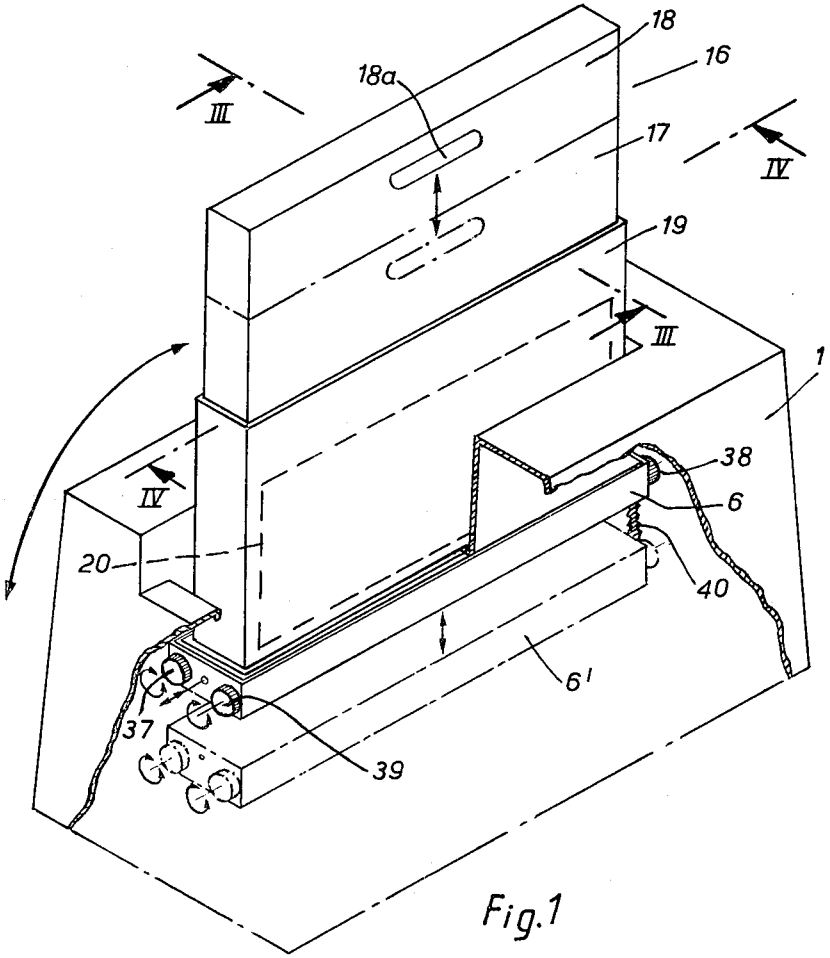
FIG. 1 shows an arrangement according to the invention for introduction of a film magazine in a film-processing device in perspective illustration together with a film magazine.

In FIG. 1, there is shown an arrangement for introduction of a film magazine to be used in combination with a film-processing device, including a housing 1 formed as light-tight covering hood. The housing 1 is arranged on the not shown film-processing unit, in which for example the exposed film of the film magazine 16 is removed therefrom and transmitted to a developer device. Such a film-processing unit has been disclosed in the commonly owned U.S. patent application Ser. No. 384,163. This processing device has means for inserting film sheets, like roller sets, and means for individually removing of film sheets from the film stack contained in the film magazine by movable suction cups and roller sets which, however, are not subject matter of the present invention and therefore are not illustrated.

Figure 2:
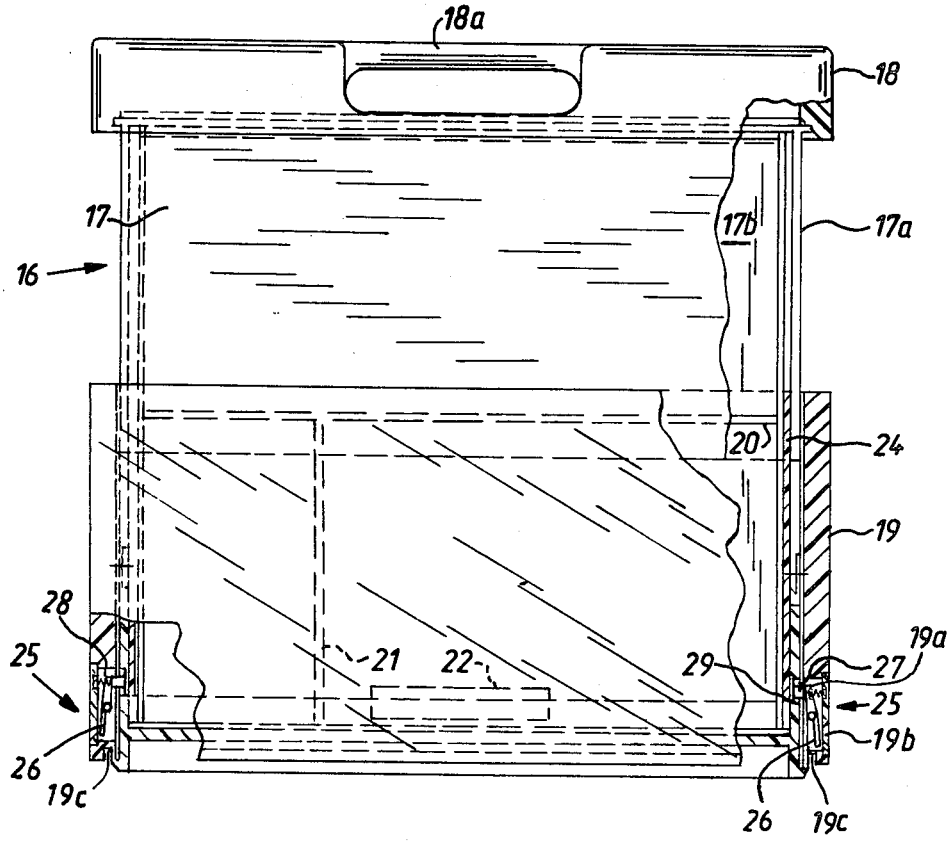
FIG. 2 is a side view of the film magazine in a partially sectional illustration.

In the covering hood 1 according to FIG. 1, there is provided an inlet slot 2 which extends in longitudinal direction of the covering hood 1 at the top face. The inlet slot 2 is provided for introduction of the film magazine 16, which is shown in FIG. 2 in more detail. The inlet slot 2 is sealed with respect to the interior of the housing by a shutter 6 which is parallel movable within the interior and prevents by suitable light shielding the penetration of light into the device as long as no film magazine 16 is placed in the inlet slot 2.

The film magazine 16, which is primarily disclosed in the commonly owned U.S. patent application Ser. No.

384,159 consists essentially of a box-shaped film stack carrier 17, a gripping handle portion 18 attached on the latter and having a handle grip 18*a*, and a casing member 19. The film stack carrier 17 is closed at all sides and has at its end remote from the gripping handle portion 18 an opening 20 which extends over the substantially entire width and at most the half height of the film stack carrier 17. The casing member 19 and the film stack carrier 17 perform a relative movement to each other, so that the interior of the film stack carrier 17 is accessible through the opening 20 through which either film sheets may be inserted and combined to a film stack 21 or can be removed individually by a combination of the suction cups which project through the opening 20. It is to be noted that such openings 20 can be arranged on both sides of the film stack carrier 17.

The gripping handle 18 is provided for transporting, inserting or removing of the film magazine 16. The casing member 19 has a rectangular cross section and an overall rectangularly prismatic outline, and so tightly embraces the film stack carrier 17 that, while the casing member 19 and the film stack carrier 17 can still be axially shifted relative to one another, undesirable penetration of light through the opening 20 is essentially eliminated. To completely eliminate light penetration, the casing member 19 is provided with a double wall which extends along the opening 20 and along the two narrow sides of the casing member 19 and being arranged at the lower side of the casing member 19. Lateral walls 17*a* and a covering wall 17*b* of the film stack carrier 17 then run between the double wall 24 and the outer wall of the casing member 19. Arranged at the narrow lateral walls of the casing member 19 and remote from the gripping handle 18 arresting elements 25 are provided which are effective between the casing member 19 and the film stack carrier 17. In a recess 19*a* of the casing member 19, a rocking element 26 is arranged which has a detaining projection 27 extending towards the film stack member 17. A compression spring 28 is inserted between the casing member 19 and the projection 27 for urging the detaining projection 27 toward the film stack carrier 17. The other end of the pivotally mounted rocking element 26 is situated at the region of an aperture 19*b* of the casing member 19 in such a manner that an actuator 10 (FIG. 4) projecting through the aperture 19*b* engages this end of the rocking element 26 so as to release the arresting element 25. As may be seen from FIG. 2, a detaining recess is provided at each of the narrow sides of the film stack carrier 17 at the ends thereof which is remote from the gripping handle. The detaining projection 27 of the rocking element 26 penetrates into and engages in the respective detaining recess 29 due to the force of the spring 28 so long as the film stack carrier 17 and the casing member 19 assume their closed position relative to one another, as can be seen in FIG. 2.

Figure 3:
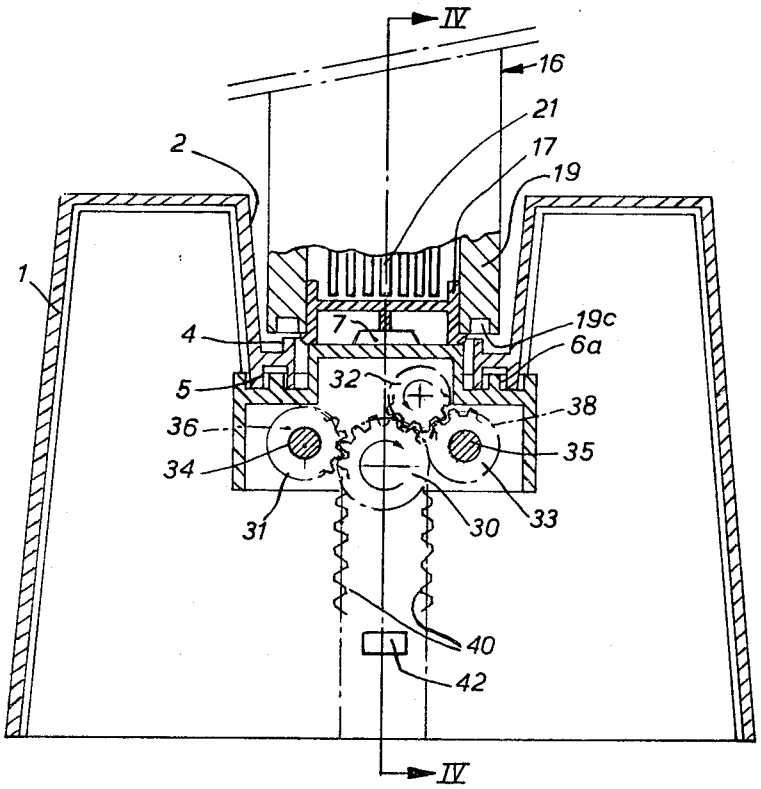
FIG. 3 is a cross section through the arrangement along the line III—III in FIG. 1.

When inserting the film magazine 16 into the inlet slot 2 of the housing 1, the casing member 19 occupies the lower end position as shown in FIG. 2, so that the opening 20 is closed in a light-tight manner. In order to be able to insert film sheets into the film magazine 16, or to remove film sheets therefrom, the opening 20 must be cleared through relative movement of the casing 19 with respect to the film stack carrier 17. These means are illustrated in FIGS. 3 and 4.

Figure 4:
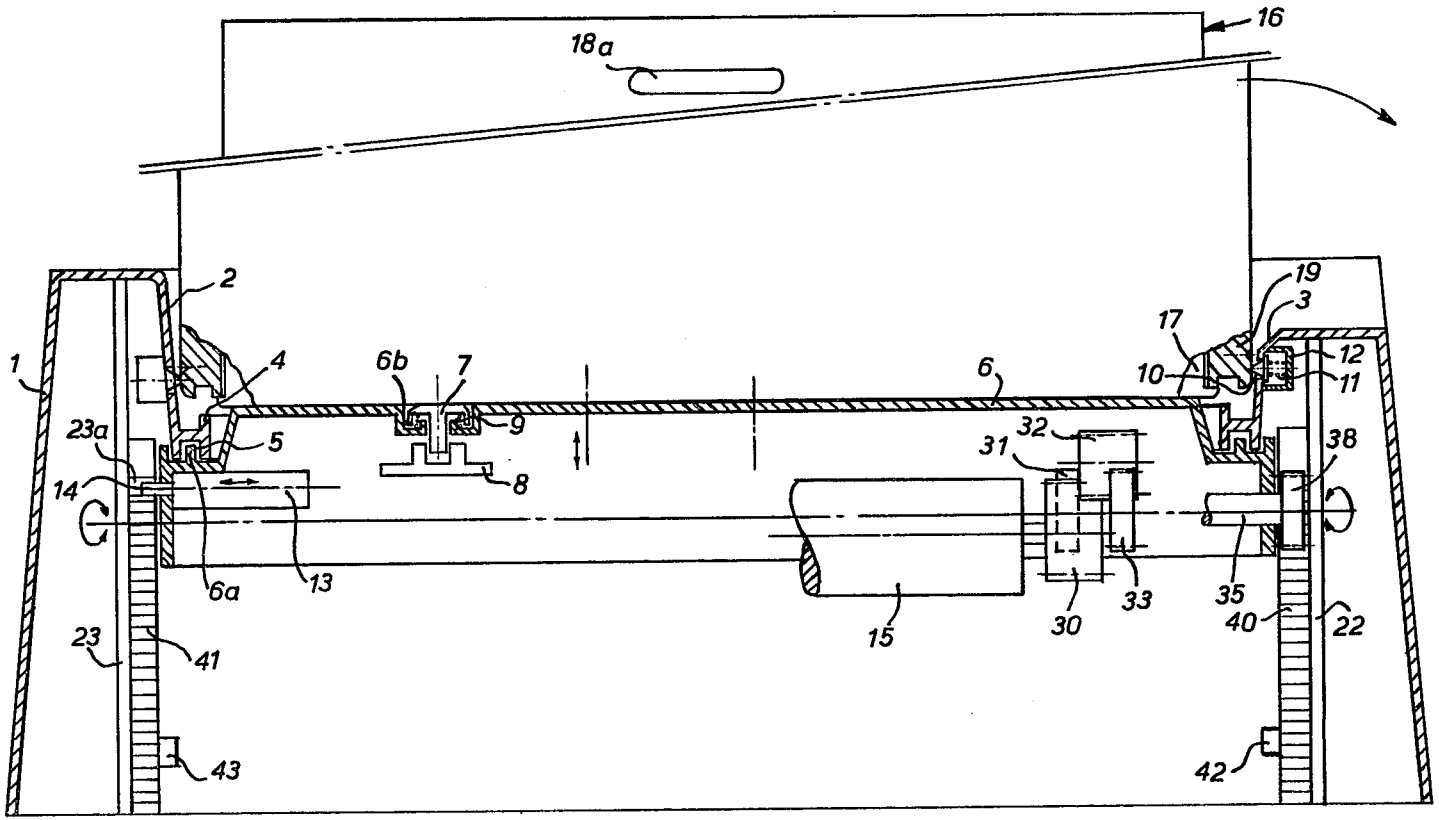
FIG. 4 is a longitudinal section through the arrangement of FIG. 1 along the line IV—IV of FIG. 1 and of FIG. 3.

As can be seen from FIG. 4, the interior of the housing 1 accommodates a shutter 6 which has essentially a box-like shape and is open towards the interior of the housing 1. The upper shutter surface serves as a support for the bottom face of the film magazine 16 inserted into the inlet slot 2. The bottom face of the film stack carrier 17 is arranged with several breakoff ribs which cooperate with T-shaped or mushroom-like feelers 7 arranged within respective indentations 6*b* in the shutter 6. The feelers 7 are lifted upwardly into its initial position by springs 9. The position of the feelers 7 are sensed by light barriers 8 which are located within the hollow space defined by the shutter 6, so that depending on the film magazine different processing programs become effective.

The shutter 6 is provided with a double edge 6*a* so as to be approximately of W-shaped cross section, which forms a part of a light-tight labyrinth. The inner side of the covering hood 1 defining the inlet slot 2, is constituted by a H-shaped edge 4 which cooperates with the circumferential edge of the shutter 6 to provide a first light shielding by engagement of the respective shanks 4*a*, 4*b* of the H-shaped edge of the covering hood 1 with the respective two recesses 5*a*, 5*b* of the W-shaped edge of the shutter 1, which recesses 5*a*, 5*b* are separated from each other by an upwardly projecting center portion 5 which provides the actual light sealing. This light sealing is effective even when the shutter 6 together with the circumferential edge is lowered with respect to the circumferential edge of the covering hood 1 about a distance corresponding to the length of the center portion 5.

A second light shielding is provided by cooperation of the shank 4*c* of the H-shaped circumferential edge of the covering hood 1 with a groove 19*c* provided in the casing member 19. The second light shielding is obtained when the shank 4*c* engages into the groove 19*c*. Through the elevated arrangement of the support surface of the shutter 6 for the film stack carrier with respect to the circumferential edge 6*a* of the shutter, such a distance is obtained between the groove 19*c* and the shank 4*c* when the casing member 19 is still in arresting position with the film stack carrier that horizontal movements of the film magazine 16 relative to the support of the shutter 6 and tilting movement in the film plane about one of the corners are possible.

For facilitating the introduction of the film magazine into the inlet slot 2, the inner walls of the housing 1 defining the inlet slot 2 are slightly bevelled. As can be seen in FIG. 4, the right inner side for the film magazine 16 is approximately of half height of the opposing inner side and additionally is bevelled in order to provide a tilting support 3 for the tilting removal of the film magazine from the inner slot 2.

Accommodated within the housing or covering hood 1 in the area of the inner sides defining the inlet slot 2 is the releasing arrangement for the arresting elements 25 which provide the locking of the film stack carrier 17 with the casing member 19. As can be seen from FIG. 4, a pressure spring 11 is arranged in a cup-shaped spring casing 12 which is provided with an opening 12*a*. One end of the pressure spring 11 rests on the housing 12, while the other end thereof abuts a tiltable releasing bolt 10 of conical shape, which is pressed into the opening 12*a* of the spring housing 12. The releasing bolt 10 is so dimensioned that the rocking element 26 is actuated when the releasing bolt 10 projects in the aperture 19*b* during the lowering of the film magazine 16, and consequently releases the arrest between the casing member 19 and the film stack carrier 17. Since the aperture 19*b* is tapered in direction towards the rocking element 26, the releasing bolt 10 can easily be disengaged from the aperture 19*b* when the film magazine is lifted again by the shutter 6. In the position of the shutter 6 and the film magazine 16 as shown in FIG. 4, the aperture 19*b* is provided with a certain distance to the releasing bolt 10, so that the arrest between the casing member 19 and the film stack carrier 17 is maintained during initial lowering of the film magazine 16. The distance between the aperture 19*b* and the releasing bolt 10 corresponds approximately to the distance between the labyrinth parts 4, 19*c* of the second light shielding.

Guidance and drive of the shutter 6 are illustrated in FIGS. 3 and 4. In the area of the inner sides of the housing 1, two support plates 22, 23 are arranged which for example carry the drive for the suction cup and the rollers for transport of the film. Further, each of the support plates 22, 23 supports a respective double gear rack 40, 41 arranged in the center of and parallel to the associated support plate. Preferably, the double gear racks 40, 41 are formed in one piece with the associated support plates 22, 23, especially when support plates are concerned which are made of plastic material. Meshing with each of the gear racks 40, 41 are associated gear wheels 36, 38; 37, 39 which are rotatably supported by shafts 34, 35 at the narrow sides of the shutter 6. Two opposing wheels are fixedly connected with each other. Accommodated in the hollow space of the shutter 6 is also a motor 15 which drives the shafts 34, 35 countercurrently via a pinion 30 and an intermediate gear 32 as well as drive gears 31, 33. The motor 15 is reversible in its direction of rotation.

As can be further seen from FIG. 4, the shutter 6 accommodates in its hollow space at least one solenoid 13 which actuates a lifting bolt 14. The lifting bolt 14 is under the influence of a spring (not shown) and engages a recess 23*a* of the support plate 23. It is to be understood that certainly a further solenoid can be provided, which cooperates with a further lifting bolt projecting into a recess provided in the other support plate 22. Upon lowering of the shutter 6, the lifting bolt 14 is retracted and disengaged from the support plate 23 by the solenoid 13. In the area of the double gear rack 40, 41, and especially connected to the support plates 22, 23, are stop members 42, 43 which limit the lower end position of the shutter 6.

After having described the apparatus, the mode of operation will now be explained:

A film magazine 16 which is sealed in a light-tight manner is inserted along the bevelled support 3 into the inlet slot 2 of the housing 1 of the film processing unit. The bottom face of the film stack carrier 17 is supported by the shutter 6 and actuates the feeler 7 in correspondence to the ribs located at the bottom face thereof. Consequently, the control means receive via the light barriers 8 coded information about the type of film stack container, for example whether a film should be inserted or removed and the kind of film. The initial position corresponds to the position shown in continuous lines in FIG. 1.

After actuation of a start button, the control electronics cause the motor 15 to temporarily rotate in a direction for lifting the shutter 6, although the shutter 6 is already in its upper end position. Through the slight lifting movement which, however, is still in the range of the elastic deformation, the lifting bolts 14 are released from being supported within the recess 23*a* and can easily be retracted through the solenoid 13. At this point, the interior of the housing is shielded in a light-tight manner by the first light-tight shielding 6*a*, 4, while the opening 20 of the film stack carrier 17 is closed in a light-tight manner by the casing member 19. After retracting the lifting bolt 14, the rotational direction of the motor 15 is reversed, and the shutter 6, which is supported only by the wheels 37, 38, 39, 40 engaging the gear racks 40, 41 is moved downwardly corresponding to the motor speed. Due to the exact parallel guidance of the shutter 6, the first light-tight shielding 6*a*, 4 is moved apart uniformly along the respective circumference, while the parts 19*c*, 4 of the second light-tight shielding approach each other until this light-tight shielding is effective. After a distance corresponding to the steps of the respective shielding shanks, the aperture 19*b* of the casing member 19 reaches the releasing bolt 10, so that through the influence of the spring 11, the rocking element 26 is released on both sides of the casing member, and consequently the film stack carrier 17 can move with respect to the casing member 19. In this phase, the casing member 19, i.e. the groove 19*c*, is in engagement with the shielding part 4 of the housing 1. Upon further lowering of the shutter 6, the film stack carrier 17 follows under the influence of its own weight the movement of the shutter 6 and is moved relative to the stationary casing member 19. Through the second light-tight shielding of the casing member 19 with the circumferential edge 4 of the housing 1, the interior of the housing, as well as the interior of the film stack carrier 17 which is progressively accessible through the opening 20, is shielded against any outside light.

The progressive lowering movement of the shutter 6 terminates upon engagement with the stop members 42, 43. Through suitable sensing, for example by means of light barriers, the motor drive can be stopped. When the film stack carrier 17 has occupied the position as illustrated in dash-dot lines in FIG. 1, the interior thereof is completely accessible through the opening 20 for loading or removing of a film.

The described arrangement of guidance and drive of the shutter 6 with the centered double gear racks and the gear wheels fixedly with each other guarantees an absolutely parallel guidance in longitudinal direction of the shutter 6, which parallel guidance is extremely important for avoiding any penetration of light. Such an arrangement is also manufacturable in a very economical way and possesses further advantage that after lowering of the shutter 6 into the position shown in dash-dot lines in FIG. 1, the space above the shutter 6 is completely free for engagement of the suction cups and guide rollers and other elements for loading or removal of film sheets.

The arrangement of the guidance is also applicable when the movement is provided in horizontal direction and the film stack carrier 17 follows the shutter 6 under the influence of an outer force like pushing by an operator or by coupling to the shutter.

After having obtained the loading or removal of film sheets, the film magazine can be taken out by reversing the motor 15 in a rotary direction opposite to the lowering movement. Upon obtaining the closed position between the casing member 19 and the film stack carrier 17, the casing member 19 engages with the projecting edge 17*a* of the film stack carrier 17 and is lifted thereby upon further upward movement of the shutter 6. The releasing bolt 10 is then tilted and disengaged from the rocking element 26, so that the arrest between the casing member 19 and the film stack carriage 17 becomes effective. During this lifting movement of the shutter 6, the second light-tight shielding provided by the groove 19*c* and the circumferential edge 4 is relieved by the first light-tight shielding provided by the circumferential edge 6*a* and the circumferential edge 4, so that the interior of the housing is protected against penetration of light regardless of the presence of a film magazine within the inlet slot.

Through lifting of the casing member 19 beyond the circumferential edge 4, the relatively heavy film magazine, which is located in the inlet slot of an arrangement placed possibly at a higher altitude, can be removed by tilting. Consequently, the removal of the film magazine is considerably facilitate in comparison to the parallel removing in upward direction. Moreover, due to the distance between the releasing bolt 10 and the aperture 19*b*, the arrest between the casing member 9 and the film stack carrier 17 is maintained at the moment of insertion of the film magazine onto the shutter, so that in case of a faulty operation, for example by removing the film magazine by lifting of the casing member 19, no damage of the film is caused. Only when through pressing of a start button the shutter 6 is lowered a predetermined part, is the arrest released.

It is to be noted that, instead of the guidance and drive of the shutter by means of gear rods 40, 41 and meshing sprocket wheels, also other linear driving means like toothed belts, tackles, and the like, can be used. Also, the motor drive is not necessarily required for the operation. Rather, the shutter 6 can be moved into the lower end position by manually pressing the film magazine against the force of a spring.

It will be understood that each of the elements described above, or two or more together, may also find a useful application in other types of apparatus for introduction of a film magazine in a film-processing unit, differing from the types described above.

While the invention has been illustrated and described as embodied in an apparatus for introduction of a film magazine in a film-processing unit, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for introduction of a film magazine in a film-processing unit, the film magazine including a casing member and a film stack carrier supporting a film stack, said film stack carrier and said casing member being movable relative to each other, said film stack carrier being releasably connectable to the casing member and having an opening for providing access to the film stack in dependence on the relative movement between the casing member and the film stack carrier, the apparatus comprising:

a housing defining an interior and being provided with an inlet slot through which the film magazine is introduced into the interior; and means for moving the film magazine in a direction of introduction into the interior of the housing from a first position, in which the film magazine is placed into the inlet slot, to a second position, in which a connection between the film stack carrier and the casing member is released, and to a third position, in which the film stack carrier performs a relative movement with respect to the casing member so that the film stack is accessible through said opening, wherein the moving means cooperate with the housing to provide a first light-tight shielding of the interior of the housing when the film magazine is in the first position and is moved into the second position, and wherein the housing cooperates with the casing member to provide a second light-tight shielding when the film magazine reaches the second position and is moved into the third position so as to prevent an undesired exposure of the film stack within the film stack carrier.

2. An arrangement as defined in claim 1, wherein the moving means includes a shutter extending along the inlet slot of the housing so as to provide a further light-tight shielding of the interior of the housing when no film magazine is placed into the inlet slot.

3. An arrangement as defined in claim 2, wherein the shutter has a surface facing the inlet slot, the surface being provided as support for the film magazine.

4. An arrangement as defined in claim 2, wherein the moving means further includes drive means arranged in the interior of the housing and cooperating with the shutter so as to guide and move the shutter within the interior of the housing.

5. An arrangement as defined in claim 4, wherein the shutter has two side walls, the drive means including a plurality of gear wheels, at least two of said wheels being provided at each of the side walls of the shutter, a pair of toothed racks extending in direction of movement of the shutter within the housing, each of the toothed racks being located at a respective side wall of the shutter and cooperating with the associated pair of said wheels, and a motor for driving said wheels along the associated toothed rack for moving the shutter between the first, second and third positions.

6. An arrangement as defined in claim 5, and further comprising means for connecting each of the gear wheels of one pair with a respective wheel of the other pair and including a respective shaft, the two shafts extending parallel to the inlet slot and being driven countercurrently by the motor.

7. An arrangement as defined in claim 6, wherein the moving means further includes two support plates for supporting means for removing each film from the film magazine, each of the support plates being arranged in the direction of movement of the shutter and fixed to the housing each of the toothed racks being connected to a respective one of the support plates and extending parallel thereto.

8. An arrangement as defined in claim 7, wherein each of the toothed racks and the associated support plate is made of one piece.

9. An arrangement as defined in claim 8, wherein each of the toothed racks and the associates support plates is made of one piece of plastic material.

10. An arrangement as defined in claim 7, wherein at least one of the support plates has an indentation, the shutter accommodating at least one solenoid at one of the side walls of the shutter, said solenoid having a lifting member projecting into the indentation of the support plate when the shutter is in the first position and being retractable by the solenoid when the shutter is moved from the first position to the second position.

11. An arrangement as defined in claim 10, wherein the motor is reversible in rotational direction thereof and supports retracting of the lifting member from the support plate by momentarily moving the shutter in the direction opposite to the movement of the latter from the first position to the second position.

12. An arrangement as defined in claim 2, wherein the shutter has a circumferential edge of approximately W-shaped cross section so that two recesses are provided arranged side-by-side and separated from each other by an upwardly projecting center portion and wherein the housing has a circumferential edge of approximately H-shaped cross section so that two further recesses are formed superposing each other and each being defined by a respective pair of shanks, the recesses of the housing, which face the shutter, cooperating with the W-shaped edge of the shutter in such a manner that the projecting center portion engages in one of the associated further recesses and the pair shanks defining the one further recess engage in the associated recesses of the W-shaped edge of the shutter for providing the first light-tight shielding in a labyrinth-like manner.

13. An arrangement as defined in claim 12, wherein the casing member has an edge provided with a running groove which cooperates with the other further recess of the H-shaped edge of the housing in such a manner that one of the shanks defining the other further recess of the H-shaped edge of the housing projects into the groove thereby providing the second light-tight shielding in a labyrinth-like manner, the two light-tight shieldings being alternatively effective when the shutter is moved between the first, second and third positions.

14. An arrangement as defined in claim 13, wherein the edge of the casing member and the one shank defining the other of the further recesses of the H-shaped edge are spaced from each other a first distance when the shutter is in the first position in which the first labyrinth-like light-tight shielding is effective so as to allow a tilting and a horizontal movement of the film magazine with-respect to the shutter.

15. An arrangement as defined in claim 14; and further comprising means for releasing the connection between the film stack carrier and the casing member, the releasing means including a releasing member cooperating with the casing member for releasing the connection between the stack carrier and the casing member when the second light-tight shielding is effective so as to render possible the relative movement of the casing member with respect to the film stack carrier.

16. An arrangement as defined in claim 15, wherein the casing member has an aperture for providing access to the releasing member for cooperation with the casing member, the aperture and the releasing member being spaced from each other a second distance corresponding to the first distance between the edge of the casing member and the one shank defining the other of the further recesses of the H-shaped edge.

17. An arrangement as defined in claim 2, wherein the film stack carrier is provided with codes; and further including means for detecting the type of a film stack carrier so as to initiate respective process steps, the detecting means being accommodated in said shutter and including at least one feeler cooperating with the respective codes provided on the film stack carrier.

18. An arrangement as defined in claim 5, wherein each toothed rack is provided with a stop member for limiting the movement of the shutter from the second position to the first position.

19. An arrangement as defined in claim 1, wherein the housing has two side members defining the inlet slot, at least one of the two side members having a bevelled edge for facilitating the introduction and removal of the film magazine in and out of the inlet slot.

* * * * *